United States Patent [19]

Pav et al.

[11] 4,347,784

[45] Sep. 7, 1982

[54] BEARINGS FOR CALENDER ROLLS AND SUPPORTS THEREFOR

[75] Inventors: Josef Pav; Gerhard Hartwich, both of Krefeld; Jörg Prey, Tönisvorst, all of Fed. Rep. of Germany

[73] Assignee: Kleinewefers GmbH, Krefeld, Fed. Rep. of Germany

[21] Appl. No.: 230,022

[22] Filed: Jan. 30, 1981

[30] Foreign Application Priority Data

Feb. 9, 1980 [DE] Fed. Rep. of Germany ..... 3004914

[51] Int. Cl.[3] ..... B30B 3/04

[52] U.S. Cl. ..... 100/162 R; 100/170; 100/168; 72/243; 308/22

[58] Field of Search ..... 100/155 R, 47, 161, 100/168, 163 R, 169, 163 A, 170, 164, 162 R, 162 B; 72/243, 248; 308/15, 22

[56] References Cited

U.S. PATENT DOCUMENTS 2,861,504 11/1958 Kane ..... 100/170 X 3,777,656 12/1973 Müller ..... 100/170 X

FOREIGN PATENT DOCUMENTS 1054953 4/1959 Fed. Rep. of Germany ... 100/163 A

*Primary Examiner*—Peter Feldman

*Attorney, Agent, or Firm*—Kontler, Grimes & Battersby

[57] ABSTRACT

A calender wherein the end portions of the lowermost roll of the roll train was mounted for movement along vertical guide rails on the stand. The lowermost roll is movable upwardly by two upright hydrostatic cylinder and piston units with plungers whose axes are coplanar with the axis of the lowermost roll. When the cylinder and piston units lift the lowermost roll to operative position, shoulders on the bearings abut against stationary stops on the stand and the stops are disposed only at one side of the common plane of the aforementioned axes so that the bearings tend to jam against the adjacent portions of the guide rails as soon as the shoulders engage the respective stops. The jamming action is enhanced if the stops are remote from the aforementioned plane and if the guide rails have T-shaped heads which are slidable in complementary T-shaped grooves of the bearings. The stops are installed at the level of the axis of the lowermost roll.

11 Claims, 2 Drawing Figures

BEARINGS FOR CALENDER ROLLS AND SUPPORTS THEREFOR

BACKGROUND OF THE INVENTION

The present invention relates to calenders in general, and more particularly to improvements in means for supporting certain rolls of the roll train in a calender. Still more particularly, the invention relates to bearings for calender rolls and to supports for such bearings, especially to bearings for the lower or lowermost roll of a train which contains at least two rolls.

It is known to mount a roll train in the spaced apart uprights of a roll stand through the medium of bearings which are movable along guides on the respective uprights. It is also known to provide such calenders with hydrostatic motors or analogous means for moving one of the outermost rolls, normally the lowermost roll of a roll train wherein the rolls are disposed one above the other, against fixed stop means so as to ensure that the one outermost roll is fixed in a selected position when the calender is in use. The bearings for the one outermost roll have surfaces which are parallel to and slide along guide faces on the respective guides. Reference may be had to U.S. Pat. No. 2,861,504 which discloses that motors in the form of cylinder and piston units serve to allow for rapid lowering of the lowermost roll or of two or more lower rolls of a roll train wherein the rolls are disposed one above the other. The bearings for the lowermost roll or rolls extend into spaces between two parallel columns of the stand, and the columns have stops against which the bearings of the lowermost roll abut in the raised position of the lowermost roll. Such mounting of bearings for the lowermost roll cannot ensure wobble-free retention of the lowermost roll in a given position.

German Auslegeschrift No. 20 10 322 discloses a calender with a substantial number of intermediate rolls between the uppermost and lowermost rolls of the roll stand. The uppermost roll is biased downwardly by a cylinder and piston unit. The stand is located at one side of the roll train and is provided with guides for the bearings of the rolls. The bearings have surfaces which abut against complementary guide faces of the guides. The guides are vertical and resemble ribs the front sides of which are contacted by the surfaces of the bearings. The bearings for the lowermost roll of the roll train are mounted differently, namely, each such bearing is disposed between two guides located at the opposite sides of the vertical plane including the axis of the lowermost roll. The part which determines the uppermost position of the lowermost roll when the calender of this German publication is in use is provided on top of the cylinder of the cylinder and piston unit which serves to lift the lowermost roll.

The aforediscussed conventional calenders share the drawback that the bearings for the lowermost roll are free to move in a horizontal plane when the calenders are in actual use. This is due to the fact that such bearings are merely slidable along the corresponding pairs of guides but cannot be locked against horizontal movement once the lowermost roll reaches its operative position. It has been found that the bearings for the lowermost rolls in such conventional calenders can move in the axial direction as well as at right angles to the axis of the lowermost roll. This leads to pronounced vibrations in a horizontal plane and attendant periodical changes in the width of the gap between the lowermost roll and the roll immediately thereabove. Vibrations of the just outlined character adversely affect the quality of the treated webs and cause pronounced wear upon the parts of the machine. Furthermore, vibrations of the lowermost roll are communicated to the cylinder and piston unit or units which serve to lift the lowermost roll to operative position so that the seals between the pistons or plungers and cylinders of such units are destroyed and the pressurized fluid is free to escape from the cylinder chambers. The intensity and extent of the just discussed vibrations of the lowermost roll is increased with increasing rotational speed of the rolls, i.e., with increasing output of the calender.

OBJECTS AND SUMMARY OF THE INVENTION

An object of the invention is to provide a novel and improved calender wherein the rolls are less likely to vibrate than in heretofore known calenders in spite of the possibility of driving the rolls at a very high speed.

Another object of the invention is to provide novel and improved roll bearings and novel and improved supports and guide means for such bearings.

A further object of the invention is to provide a calender which embodies the improved bearings and the improved support and guide means for the bearings.

An additional object of the invention is to provide novel and improved means for holding the lowermost roll of a roll train consisting of superimposed rolls against any or against excessive vibratory movements when the calender is in use.

Another object of the invention is to provide the stand of a calender with novel and improved guide means for the bearings of certain rolls, especially for the bearings of the lower or lowermost roll of a train of two or more superimposed rolls.

A further object of the invention is to provide novel and improved composite bearings for the lowermost roll of the roll train in a supercalender or an analogous machine.

An ancillary object of the invention is to provide a simple and compact calender which is designed to reduce the wear upon its parts and to prolong the useful life of fluid-operated motors which are employed therein, especially of that motor or those motors which serve to raise and to maintain the lowermost roll in an operative position.

The invention is embodied in a calender which comprises a stand having elongated guide means (preferably two spaced apart vertical or nearly vertical guide rails), a roll train mounted in the stand and having an outermost roll (this outermost roll is preferably the lowermost roll if the roll train consists of superimposed rolls), bearing means for the outermost roll, cooperating surfaces provided on the guide means and bearing means to enable the bearing means to slide along the guide means in directions to move the outermost roll toward or away from the neighboring or nearest roll, stop means provided on the stand, and motor means which is operable to move the bearing means along the guide means in a direction to advance the outermost roll against the neighboring roll of the roll train and to engage the bearing means with the stop means. The motor means includes a reciprocable component (e.g, the plunger of a cylinder and piston unit) having an axis which is disposed in a predetermined plane, e.g., in a plane which includes the axis of the outermost roll. The stop means is disposed only at one side of the aforementioned plane so that, when the motor means moves the bearing means against the stop means, the bearing means tends to tilt about the stop means and thereby jams against the guide means to lock itself to the guide means, i.e., to be held against uncontrolled or undesirable movements relative to the stand as long as the motor means continues to maintain the bearing means in abutment with the stop means.

In accordance with another feature of the invention, the guide means is also disposed only at the one side of the aforementioned plane.

The bearing means includes two discrete bearings, one at each axial end of the outermost roll, and the stand preferably carries two discrete stops, one for each discrete bearing. The bearings preferably define T-shaped grooves which receive complementary T-shaped portions of the guide rails and the aforementioned surfaces include internal surfaces in the grooves of the bearings and external guide faces on the guide rails. Some of the guide faces face away from the outermost roll.

If the common plane of the rolls forming the roll train is vertical of if the movement of the bearings along the guide rails has a vertical component, the stop means is preferably located at the level of the axis of the outermost roll which is then the lowermost roll of the roll train.

The novel features which are considered as characteristic of the invention are set forth in particular in the appended claims. The improved calender itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 2:
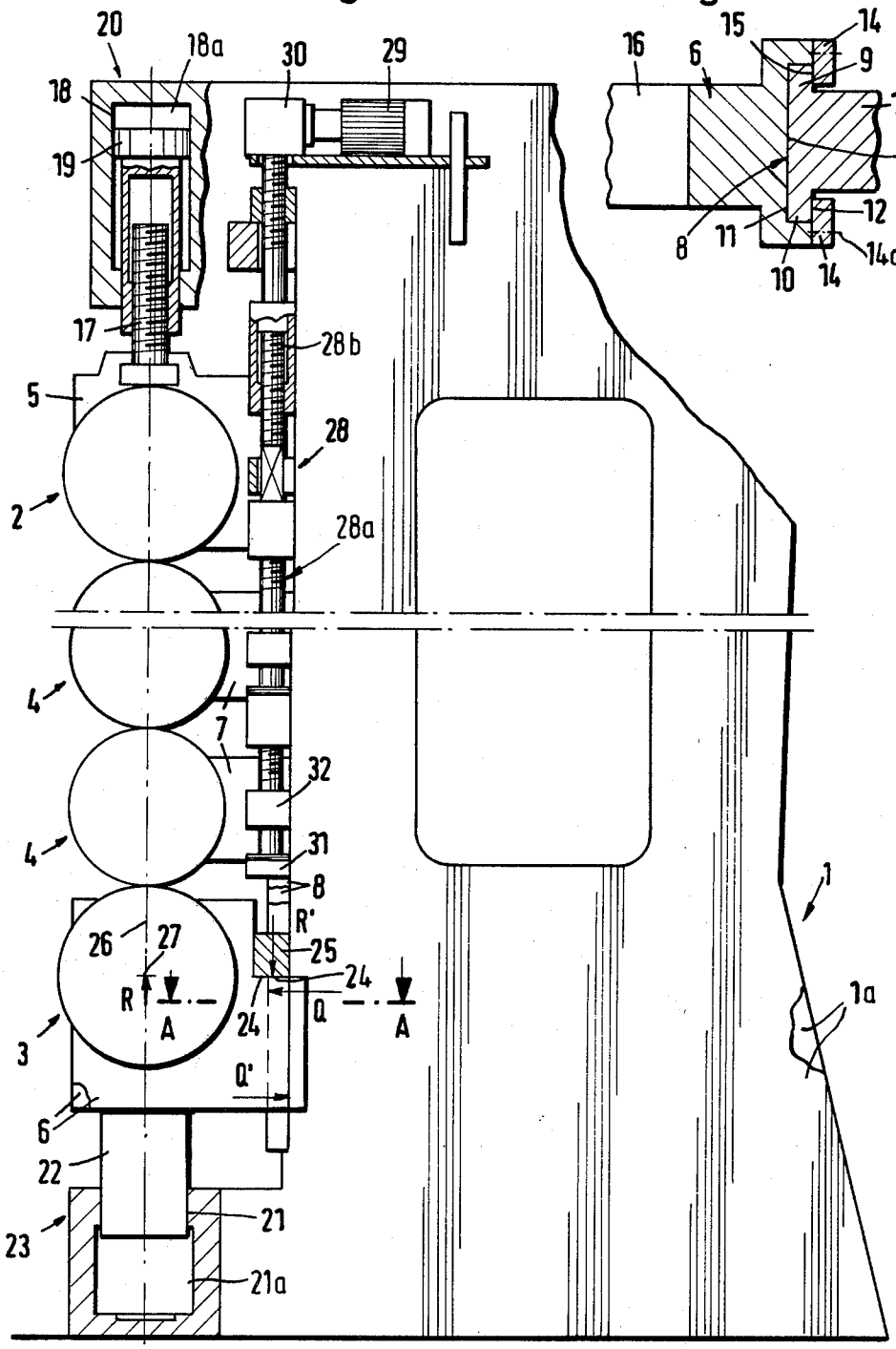
FIG. 1 is a fragmentary partly side elevational and partly vertical sectional view of a calender which embodies the present invention.
FIG. 2 is an enlarged fragmentary horizontal sectional view as seen in the direction of arrows from the line A—A of FIG. 1.

Referring first to FIG. 1, there is shown a calender which comprises a stand 1 having two spaced apart uprights 1*a* and a roll train installed in the stand in such a way that the axes of the rolls are horizontal and the rolls are disposed one above the other. The train includes an uppermost or outermost roll 2, an outermost or lowermost roll 3 and several intermediate rolls 4. The number of intermediate rolls 4 can greatly exceed two. The end portions of the uppermost roll 2 are mounted in two discrete bearings 5 which are movable up and down along vertical guide rails or ways 8 on the respective uprights 1*a*. Analogously, the end portions of the intermediate rolls 4 are mounted in bearings 7 which are reciprocable along the respective rails 8. The bearings 6 for the lowermost roll 3 are reciprocable along the respective rails 8 at a level below the lowermost bearings 7. As shown in FIG. 2, each of the guide rails 8 has a substantially T-shaped cross-sectional outline with two spaced apart parallel vertical ribs 9 and 10 extending from the opposite sides of the corresponding upright 1*a*. Those sides of the ribs 9 and 10 which face away from the roll train 2–4 have parallel guide faces 12, and the front side of the guide rail 8 shown in FIG. 2 constitutes a further guide face 11 which is parallel to the guide faces 12. The bearing 6 which is shown in FIG. 2 defines a groove which is complementary to the profile of the corresponding guide rail 8 and is bounded in part by two internal surfaces 15 abutting against the guide faces 12 as well as by a further internal surface 13 adjacent to the guide face 11 of the guide rail 8. The internal surfaces 15 are provided on removable strip-shaped portions 14 of the bearing 6; the portions 14 are separably but rigidly connected to the main portion of the bearing 6 by bolts 14*a* or analogous fastener means (denoted by phantom lines). The reference character 16 denotes in FIG. 2 a circular or otherwise configurated opening of the bearing 6 for reception of the corresponding end portion of the lowermost roll 3. The other bearing 6 is preferably identical with that shown in FIG. 2, and the bearings 5 and 7 are preferably similar to or identical with the bearings 6. The only difference is normally that the removable portions 14 of the bearings 6 are stronger (i.e., their cross sections are larger) than the removable portions (if any) of the bearings 7 and 5.

The uppermost bearings 5 are urged downwardly by hydrostatic motors 20 (only one shown) each of which constitutes a fluid-operated cylinder and piston unit having an axially adjustable spindle 17 secured to the respective bearing 5, a piston 19 which is reciprocable in the cylinder 18 of the respective motor 20 and meshes with the spindle 17, and a cylinder chamber 18*a* defined by the cylinder 18 and receiving pressurized fluid from a suitable regulating unit (not shown) so as to urge the peripheral surface of the uppermost roll 2 against the peripheral surface of the nearest intermediate roll 4 with a predetermined but variable force. Adjustability of the spindles 17 relative to the corresponding pistons 19 is necessary or desirable in order to compensate for removal of material from the peripheral surfaces of the rolls; such removal or refinishing of the peripheral surfaces must be carried out from time to time and entails a reduction of the diameters of the rolls. The pressure of fluid in the cylinder chambers 18*a* is selected with a view to subject the web of paper or other material which is treated by the calender to a desired pressure, i.e., to a pressure in addition to that which is generated by the weight of the rolls 2 and 4.

Each of the two bearings 6 for the lowermost roll 3 is movable up and down by a discrete hydrostatic motor 23 including a stationary cylinder 21 defining a chamber 21*a* for the lower end portion of a plunger 22 which is connected to or merely bears against the underside of the respective bearing 6. The pressure of hydraulic fluid in the cylinder chambers 21*a* suffices to maintain horizontal portions of shoulders 24 of the bearings 6 in contact with stationary stops 25 on the respective uprights 1*a*. Furthermore, such pressure must suffice to hold the bearings 6 against movement away from the respective stops 25 under the combined weight of the rolls 2 and 4, against downward movement under the action of pressurized fluid in the cylinder chambers 18*a*, and against downward movement under the action of the treated web which is caused to advance through the calender. The resultant force is denoted by the arrow R and acts upwardly in a plane 26 denoted by a vertical phantom line and including the axes of the plungers 22. It will be noted that the guide rails 8 on the two uprights 1*a*, the two stops 25, and the shoulders 24 on the bearings 6 are all located at one side of the plane 26. The shoulders 24 and stops 25 are located at the general level of the axis 27 of the lowermost roll 3. The resultant force R is counteracted by a downwardly oriented force R' in the region of the stop 25, i.e., in a plane which is parallel to the plane 26 and is adjacent to the guide rails 8 on the two uprights 1*a*. Since the two planes (of the resultant forces R and R') are spaced apart from each other, the motors 23 generate moments which tend to pivot the bearings 6 relative to the corresponding guide rails 8 and in a clockwise direction, as viewed in FIG. 1. Such moments cause the upper portions of the internal surfaces 13 of the two bearings 6 to bear against the front guide faces 11 of the corresponding rails 8 and the lower portions of the internal surfaces 15 to bear against the adjacent portions of the guide faces 12 of the ribs 9 and 10. In other words, the moments which develop as a result of offset between the motors 23 and the stops 25 cause the lowermost bearings 6 to jam against the corresponding portions of the respective guide rails 8 with the result that the lowermost roll 3 is even more reliably held against any movements relative to the stand 1 when the shoulders 24 of the bearings 6 are caused to abut and bear against the respective stops 25 under the action of pressurized fluid in the cylinder chambers 21*a*. The force with which the upper portions of the internal surfaces 13 bear against the adjacent portions of the front guide faces 11 (and more particularly the resistance which the guide rails 8 offer to the pressure exerted by the upper portions of internal surfaces 13) is indicated by the arrow Q, and such force is opposed by an equally large force Q' developing as a result of pressure of the lower portions of internal surfaces 15 against the adjacent portions of the guide faces 12 on the ribs 9 and 10. The forces Q and Q' act at different levels; therefore, such forces also contribute to jamming of the bearings 6 against the adjacent portions of the respective guide rails 8 so that the lowermost roll 3 is even less likely to leave its upper end position in which the shoulders 24 of the bearings 6 engage the corresponding stops 25. Moreover, the forces Q and Q' generate friction between the guide faces 11, 12 on the one hand and the internal surfaces 15 and 13 on the other hand which also contributes to reliable retention of the bearings 3 in the optimum (uppermost) positions. Since the shoulders 24 are located at the level of the axis 27 of the lowermost roll 3, eventual minor angular displacements of the bearings 6 in response to the action of the motors 23 when the shoulders 24 engage the corresponding stops 25 does not entail any or only negligible lateral shifting of the roll 3, i.e., a shifting in a horizontal plane as viewed in FIG. 1. The same or a similar result is achieved if the shoulders 24 are located somewhat above the level of the axis 27 in order to allow for a lengthening of the internal surfaces 13 and 15 on the bearings 6. Such lengthening of the internal surfaces 13 and 15 further enhances the clamping or jamming action when the motors 23 cause the shoulders 24 to bear against the adjacent stops 25. It is also possible to locate the shoulders 24 at least slightly below the level of the axis 27.

In certain or all other respects, the calender which embodies the structure of FIGS. 1 and 2 can resemble a conventional calender. Thus, the suspending unit 28 which supports the bearings 7 for the end portions of the intermediate rolls 4 can be of conventional design. It comprises a reversible electric motor 29 which can drive a vertical feed screw 28*a* through the medium of a suitable transmission 30, e.g., a bevel gear transmission. The feed screw 28*a* carries nuts 31 which can serve as rests for lugs 32 on the respective bearings 7. The lugs 32 come to rest on the adjacent nuts 31 when the operator decides to evacuate the pressurized fluid from the cylinder chambers 21*a* so as to allow for separation of neighboring rolls of the roll train. Thus, when the motors 23 permit it, the lowermost roll 3 descends to a lower end position and the intermediate rolls 4 move downwardly to the extent selected by the positions of nuts 31 on the feed screw 28*a*.

The feed screw 28*a* of the illustrated suspending unit 28 comprises a plurality of discrete sections 28*b* which can be rotated relative to each other to thereby move axially and change the spacing between neighboring nuts 31, i.e., to change to spacing between the rolls when the lowermost roll 3 is caused to descend to its lower end position. The motor 29 is started when an attendant wishes to simultaneously displace all of the nuts 31. The individual sections 28*b* of the feed screw 28*a* are rotated relative to each other when an attendant wishes to change the distance between a pair of selected nuts 31. However, it is equally within the purview of the invention to use a one-piece feed screw 28*a* with nuts 31 which are held against rotation with the feed screw.

An important advantage of the improved calender is that the guide means for its bearings, especially for the bearings 6 of the lowermost roll 3 of the roll train, are simpler than in heretofore known calenders. This is attributable to the fact that the guides 8, the shoulders 24 and the stops 25 are all located at one side of the plane 26, i.e., at one side of the plane of the lines of action (arrow R) of the plungers 22 of hydrostatic motors 23 which urge the lowermost roll 3 to its upper end position. The result of such mounting is the aforementioned jamming of the bearings 6 against the adjacent portions of the guide rails 8 so that the bearings 6 are held against movement in a horizontal plane including the axis 27 of the lowermost roll 3, namely, against any stray movements in the axial direction of the lowermost roll 3 as well as at right angles to the axis of the roll. Upward movements of the roll 3 are prevented by the shoulders 24 which bear against the adjacent stops 25 under the action of pressurized fluid in the cylinder chambers 21*a*, and downward movements of the roll 3 are prevented by the fluid in the chambers 21*a*. Thus, the lowermost roll 3 is positively held against any movement other than rotation about its axis 27. As mentioned above, the angular displacement of the bearings 6 preparatory to jamming against the adjacent portions of the guide rails 8 is negligible, especially if the shoulders 24 are located at or close to the level of the axis 27, so that the extent to which the axis 27 moves out of the common plane of the axes of the rolls thereabove is negligible and does not affect the operation of the calender. Jamming of the bearings 6 generates frictional forces which further reduce the likelihood of vibration and/or other stray movements of the lowermost roll 3 when the cylinder chambers 21*a* are filled with pressurized fluid which is maintained at adequate pressure, namely, at a pressure which suffices to maintain the shoulders 24 in contact with the stops 25 in opposition to the combined weight of the rolls 2 and 4, in opposition to the pressure of fluid in the cylinder chambers of the motors 20, and in opposition to the stresses which are generated as a result of travel of a web of paper or other flexible material through the nips of neighboring rolls. Friction which develops as a result of jamming of the bearings 6 against the adjacent portions of the guide rails 8 is especially effective in preventing stray movements of the bearings 6 in the axial direction of the lowermost roll 3. All forces which tend to vibrate the roll 3 are transmitted to and damped by the stand 1. Vibratory movements in directions which are parallel to the longitudinal directions of the guides 8 are prevented or held to a minimum for several reasons, namely, as a result of jamming of the bearings 6 as well as because the shoulders 24 of the bearings 6 are biased against the adjacent stops 25. It has been found that the reduction of vibration of the lowermost roll 3 is so pronounced that the wear upon the mobile parts of the improved calender is but a small fraction of wear upon the parts of conventional calenders. Moreover, the useful life of seals for the plungers 22 in the hydrostatic motors 23 is surprisingly long, again owing to pronounced reduction or elimination of vibrations of the lowermost roll 3.

The placing of guide rails 8, shoulders 24 and stops 25 only at one side of the common plane 26 of the axes of the rolls 2 to 4 brings about additional advantages. Thus, the construction of the stand 1 and its guides is simpler than in heretofore known calenders and all of the rolls and their bearings are readily accessible from the front side of the calender. This also applies for the bearings 6 which carry the end portions of the lowermost roll 3. The space requirements of the bearings 6 are surprisingly small and the entire machine is simpler than heretofore known calenders wherein the bearings for the lowermost roll are mounted in the conventional way. Moreover, and since the entire front side of the improved calender is readily accessible, removal of any given roll from the stand 1 presents fewer problems and can be completed within a shorter interval of time than in a conventional calender.

The configuration of the guide rails 8 with a pair of ribs 9 and 10 as shown in FIG. 2 was already tested in connection with the bearings for intermediate rolls of a roll train. It has been found that such guides can be used with advantage in the calender of the present invention; all that may be necessary is to strengthen the strips 9 and 10, i.e., to make such strips of a suitable material and to select the dimensions of the strips in such a way that they can readily stand the stresses which develop when the bearings 6 are caused to jam against the adjacent portions of the guide rails 8.

The mounting of the undersides of the stops 25 at the general level of the axis 27 of the lowermost roll 3 brings about the aforementioned advantages, especially the absence of noticeable horizontal shifting of the axis 27 when the bearings 6 tend to pivot about the stops 25 after the plungers 22 have completed the movement of the shoulders 24 into abutment with the respective stops 25. If any pivoting about the stops 25 does occur, it entails some slight upward movement of the axis 27 but the extent of movement of the axis out of the plane 26 is practically nil.

The improved calender is susceptible of many modifications without departing from the spirit of the invention. For example, the relatively simple roll 3 of FIG. 1 can be replaced with a more complex roll of the type wherein a shaft-like carrier which is non-rotatably mounted in two bearings is surrounded by a sleeve including a cylindrical member and two inserts at the axial ends of the cylindrical member. The cylindrical member contains one or more rows of hydrostatic cylinder and piston units whose cylinder chambers can receive pressurized fluid to prevent flexing of the cylindrical member. Reference may be had to the commonly owned copending application Ser. No. 232,197 filed Feb. 6, 1981 by Josef Pav for "Calender". Furthermore, the guides 8 need not be vertical, i.e., each guide can have a horizontal component; such calenders may be equipped with means for positively moving the lowermost roll away from the nearest intermediate roll when the width of the gaps between neighboring rolls is to be increased or when the calender is to be prepared for removal of a selected roll.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. In a calender, the combination of a stand having elongated guide means; a roll train mounted in said stand and having an outermost roll; bearing means for said outermost roll, said guide means and said bearing means having cooperating surfaces enabling said bearing means to slide along said guide means; stop means provided on said stand; and motor means operable to move said bearing means along said guide means in a direction to advance said outermost roll against the neighboring roll of said train and to engage said bearing means with said stop means, said motor means including a reciprocable component having an axis disposed in a predetermined plane and said stop means being disposed only at one side of said plane.

2. The combination of claim 1, wherein said train consists of superimposed rolls and said outermost roll is the lowermost roll of said train.

3. The combination of claim 1, wherein said plane includes the axis of said outermost roll.

4. The combination of claim 1, wherein said guide means is also disposed only at said one side of said plane.

5. The combination of claim 4, whrein said motor means includes a plurality of cylinder and piston units having parallel plungers which constitute said reciprocable component of said motor means.

6. The combination of claim 1, wherein said guide means includes an elongated rail having a pair of spaced apart parallel ribs and said surfaces include guide faces provided on said ribs and facing away from said outermost roll.

7. The combination of claim 6, wherein said bearing means includes a portion surrounding said ribs and said surfaces further include internal surfaces provided on said portion of said bearing means and adjacent to said guide faces.

8. The combination of claim 1, wherein said guide means includes a rail having a substantially T-shaped cross-sectional configuration and said bearing means has a groove whose outline is complementary to said configuration, said rail extending into said groove and said surfaces including internal surfaces in said groove and external guide faces on said rail.

9. The combination of claim 1, wherein said outermost roll has a substantially horizontal axis and said stop means is located at the general level of said axis.

10. The combination of claim 9, wherein said plane is at least substantially vertical and includes the axis of said outermost roll, said bearing means having shoulder means normally abutting against said stop means and said stop means being spaced apart from the axis of said outermost roll as considered at right angles to said plane.

11. The combination of claim 1, wherein said outermost roll has two end portions and said bearing means includes two discrete bearings, one for each of said end portions, said guide means including a discrete guide for each of said bearings and said stop means including a discrete stop for each of said bearings.

* * * * *